United States Patent [19]

Lee

[11] Patent Number: 4,852,642

[45] Date of Patent: Aug. 1, 1989

[54] HEAT EXCHANGE DEVICE

[76] Inventor: Yong N. Lee, 1010 W. Lonnquist Blvd., Mt. Prospect, Ill. 60056

[21] Appl. No.: 118,209

[22] Filed: Nov. 6, 1987

[51] Int. Cl.[4] ..... F28F 13/12

[52] U.S. Cl. ..... 165/109.1; 165/85

[58] Field of Search ..... 165/109.1, 85, 120, 165/88, 87; 138/38, 37, 39; 416/96

[56] References Cited

U.S. PATENT DOCUMENTS

| | | | |
|---|---|---|---|
| 4,261,112 | 4/1981 | Apitz | 165/90 X |
| 4,377,202 | 3/1983 | Nakamura et al. | 165/86 |
| 4,621,684 | 11/1986 | Delahunty | 165/92 |

*Primary Examiner*—Larry Jones

*Attorney, Agent, or Firm*—Robert A. Brown

[57] ABSTRACT

A heat exchange device including at least one inner cylinder member and at least one outer cylinder member, defining therebetween one or more annuli through which pressurized heat exchange medium is forced to flow. One or more rotatable members having formed thereon a plurality of finger-like projections that define longitudinal continuous or segmented grooves are disposed within the annuli. The pressurized heat exchange medium imparts angular force to the rotatable member causing it to flow vary rapidly with great vorticity within the grooves and also between the distal ends of the finger members and the adjacent containing circumferential surface of the inner and outer cylinder members. In some cases, angular force is imparted to the rotatable member(s) by external power sources, as a supplement to the flow of the pressurized heat exchange medium. The rapid flow and vorticity of the heat exchange medium is effective to acheive at least a ten fold increase in heat transfer gradients or coefficients while at the same time maintaining only a nominal increase in pressure drop through the device.

18 Claims, 5 Drawing Sheets

HEAT EXCHANGE DEVICE

BACKGROUND OF THE INVENTION

The present invention relates generally to heat transfer equipment and more particularly to a coaxial cylinder system wherein at least one angularly movable member rotates within an intermediate outer cylinder and/or an external cylinder to greatly enhance an exchange of heat or cooling of fluid or other heat transfer medium flowing throughout the system.

DESCRIPTION OF THE PRIOR ART

Theories and concepts of means to transfer differences of temperature between various mediums or bodies of fluids are generally well known. In the past, attempts have been made to increase the coefficient of heat transfer between two surfaces having a fluid in contact therewith by means of increasing the heat transfer area of contact between surfaces having a difference in temperature gradient, by the control of boundary layer flow over the surfaces, by increasing the flow rate between the heat transfer surfaces and by attempting to eliminate boundary layer by scraping the heat transfer surfaces. These concepts are limited in that increase of area of contact, control of boundary layer and increase of flow rate all result in increased pressure drop. Further, when a moving member scrapes along a surface of a stationary member to remove the thermal barrier therefrom, the resulting frictional movement between a fluid and its containing surface causes problems associated with excessive wear of materials, creates a need for increased requirements of power and incurs greater costs associated with consumption thereof.

In general applications, however, fluids can be any types including refrigerants, and the heat transfer direction can be either cooling or heating. In the conventional oil cooler, two concentric tubes form an annulus, through which oil passes and water passes through the inner tube; the outside of the outer tube is covered by either an insulator, or exposed to fluids such as air, water, etc. Hot oil is cooled due to heat transfer through the tube wall to cool water. To enhance heat transfer, various augmentation parts are inserted (soldered to tubes or mechanically compressed) in the annulus. Insertion of the parts increases heat transfer rate between the two fluids, but it accompanies an increased pressure drop. The increase in pressure drop is undesirable, since energy is consumed to overcome it. Not only for the consumption of energy (extra), but also as a constraint of any heat exchanger, there is normally a maximum allowable pressure drop specified.

Illustrative of past attempts to solve the basic problem of transferring a significantly greater quantitative amount of heat for a given envelope are illustrated in U.S. Pat. Nos. 2,119,907; 2,394,109; 2,568,807; 2,802,646; 2,943,845; and 4,261,112. In addition, U.S. Pat. Nos. 4,331,198; 4,377,202; 4,574,872; 4,582,128; and 4,621,684 deal more specifically with rotating members for the transfer of heat therebetween, and though effective to some degree, fail to achieve the results obtained by the extremely compact, greatly increased efficient heat exchange device as disclosed herein.

The Dunlap '907 patent is primarily a heating apparatus for liquids such as milk and utilizes rotating vanes to impart rotary motion to the liquid. Internal nozzles are used to direct liquid into contact with the vanes. Sanchez '109 is a classic example of a rotary heat exchanger that uses kinetic energy as supplied by expanding refrigerant to propel a fan. Jayne '807 is another example of a rotary heat exchanger that utilizes kinetic energy to propel the blades of a fan. Jetter '646 relates to a rotary regenerative air preheater to provide the necessary motive power to turn a rotor about its axis of rotation. Apitz '112 shows a rotatable heat exchange drum for heating and/or cooling an elongated material. A channel provides a pathway for swirling movement of fluid so as to prevent stagnation in an annular gap. Michalska, et al '198 discloses a plurality of coaxial discs mounted for rotation about a center axis that cause fluid to flow generally parallel to the center axis. Hirakata, et al '872 is concerned with controlling mixing fluids that originate from two adjacent heat exchangers. Jarreby '128 shows the concept of using a helically extending rib to guide fluid in a helical flow path. Delahunty '684 uses circular shaped finned, discs in combination with orifices to effect circulation of fluid streams and channels.

SUMMARY OF THE INVENTION

Accordingly, it is a primary object of the present invention to provide an improved heat exchange device that increases the rate of heat transfer between surfaces of at least two stationary cylinders by rotating therebetween at least one member having inner and outer circumferential surfaces wherein any of the surfaces may be smooth to induce vorticity therein and impart greater relative motion within a given envelope.

Another object of the present invention is to provide an improved heat exchange device that increases the rate of heat transfer between surfaces of at least two stationary cylinders by rotating therebetween at least one member having inner and outer circumferential surfaces wherein any one or more of the surfaces may have formed thereon projections to induce vorticity therein and impart greater relative motion within a given envelope.

An additional object of the present invention is to provide an improved heat exchange device that rotates fluid through an annulus between an internal and an external cylinder so as to generate "Taylor" vorticity and greatly increase the transfer of heat between the cylinders.

A further object of the present invention is to provide an improved heat exchange device that causes a circulation of heat exchange medium within preselected, longitudinallyoriented confined or segmental spaces of a member rotatable within a stationary cylinder to thereby increase the rate of heat transfer therebetween.

A still further object of the present invention is to provide an improved heat exchange device that causes a counter-flow circulation between outer ends of projections formed on a member rotatable within a stationary cylinder so as to increase the rate of heat transfer therebetween.

Another object of the present invention is to provide an improved heat exchange device that combines both circulation and counter circulation of heat exchange medium between a member rotatable within a stationary cylinder and thereby greatly increase the heat transfer coefficient therebetween.

An improved heat exchange device constructed in accordance with the present invention comprises outer stationary cylindrical means having inlet and outlet means, inner stationary cylindrical means having an inlet end portion and an outlet end portion; rotatable, cylindrical means disposed within the outer and inner stationary cylindrical means, the rotatable cylindrical means when moving angularly within the outer and inner stationary cylindrical means being effective to cause circulation and counter circulation within an annulus defined by the inner circumferential surface of the outer stationary cylindrical means and the outer circumferential surface of the inner stationary cylindrical means so as to greatly increase the heat transfer coefficient therebetween.

BRIEF DESCRIPTION OF THE DRAWING

The foregoing and other characteristics, objects, features and advantages of the present invention will become more apparent upon consideration of the following detailed description, having reference to the accompanying figures of the drawing, wherein.

DESCRIPTION OF A PREFERRED EMBODIMENT

The inventive concept of heat exchange devices as disclosed herein may function either as a separate heat exchanger or as a component of a system. In a general sense, the transfer of heat from one medium to another, either from a lower temperature level to a higher temperature level, such as heating; or from a higher temperature level to a lower temperature level, such as cooling, can be accomplished by the use of a number of different types of heat transfer agents, for example, liquids, vapors, gases, mixtures thereof, and the like. Liquids and gases may be considered single phase flow agents. In the event it is desired to utilize two phase flow agents, such as required in some refrigeration processes, it is possible to employ a number of chemical compound gases, in addition to acqueous solutions. In a conventional type of heat exchange application, two concentric tubes or cylinders form an annulus therebetween and, for example, liquid being cooled is forcibly moved from an inlet port through the annulus to an outlet port, while coolant is forcibly circulated in a counter flow direction from an entry end leading into the enclosed space of the inner cylinder and caused to exit therefrom through an outlet located at the other end of the inner cylinder enclosed space.

Figure 1:
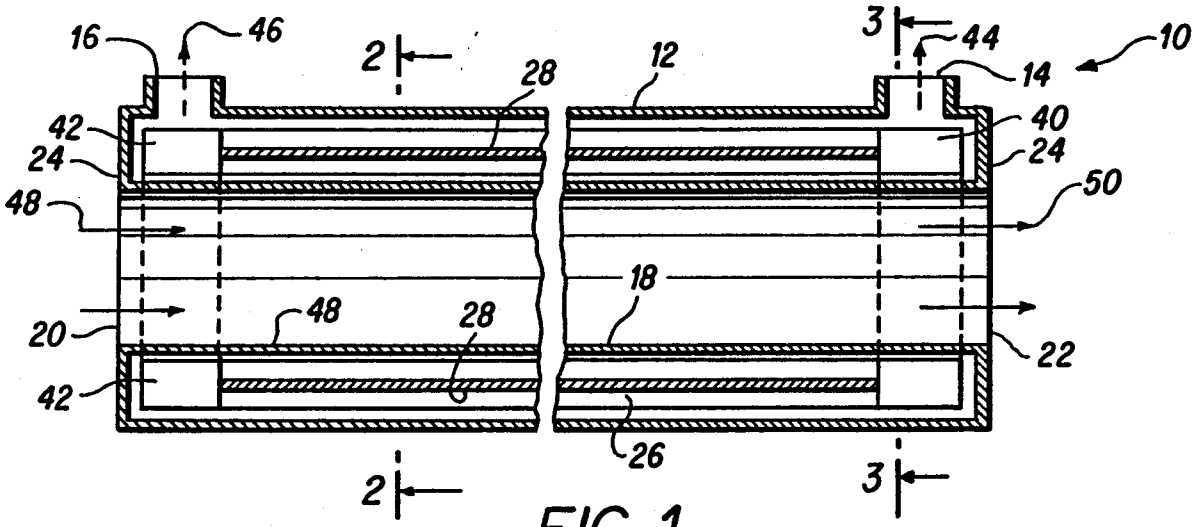
FIG. 1 is a longitudinal, sectional view of an improved heat exchange device of the invention showing an internal stationary cylinder and an outer stationary cylinder including a rotatable member therebetween wherein arrows depict the manner in which fluids flow through the device.
Figure 3:
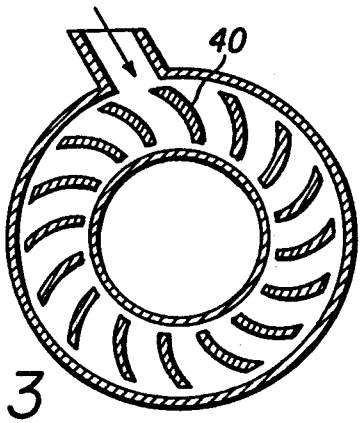
FIG. 3 is a sectional view taken along the lines 3—3 of FIG. 1 showing the construction of a turbine end portion disposed at both ends or at any other desired selective positions on the rotatable member that receives flowing fluid, is caused to rotate thereby and imparts angular motion to the rotatable member.

To illustrate this concept of heat exchanger, a counter-flow tubular liquid to liquid cooler is shown as an example in FIG. 1. The present concept as hereinafter defined by a preferred embodiment improves over prior, conventional means to augment a heat transfer gradient by providing a rotating, grooved cylinder disposed within the annulus defined between an inner and outer cylinder. Rotational motion is obtained by an angular torque force generated by turbine members mounted at inlet and outlet ends of the rotating cylinder. The turbine members are adaptable to receive a fast moving heat transfer medium and thereafter direct the medium into the annulus and also into longitudinal grooves formed on the rotatable cylinder.

In a variation of the concept, the grooves may be formed spirally around the cylinder in such a way that the grooves themselves can act as turbine impellers. Thus, the total pressure head available in the flow system is utilized to rotate the cylinder, rather than being dissipated as lost energy. Another version of the present concept is disclosed wherein a secondary outer tube or cylinder forms an additional annulus through which heat transfer medium flows. An additional version includes the concept of forcing air as a coolant through the enclosed space of the inner cylinder by using another rotating cylinder. The preferred concept of heat transfer autmentation can be utilized in a number of different ways. For instance, a heat exchanger can be used as a separate, individual component; it can be part of a total system; or it can be used as a combination of these two applications.

Now referring to the figures of the drawing wherein reference numerals are used to indicate like numbered parts, and directing attention specifically to FIG. 1, there is shown an improved heat exchange device, generally identified by reference numeral 10. The device 10 comprises an outer cylindrical member 12 having an inlet port 14 disposed at one end of the member 12 and an outlet port 16 disposed at the other end of the member 12. The device 10 further comprises an internal cylinder 18 including an entry end 20 at one end thereof and an exit end 22 at the other end of the internal cylinder 18. Disposed at both ends of the device 10 are partial end wall members 24 that connect the outer cylinder 12 to the inner cylinder 18 so as to form therebetween a predetermined, defined, closed space or annulus 26.

Figure 2:
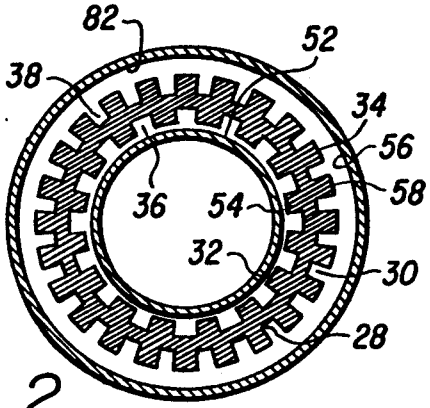
FIG. 2 is a sectional view taken along the lines 2—2 of FIG. 1 showing the manner in which internal, longitudinal grooves are formed in the rotatable member for receiving the moving fluid as it flows through the device.

Disposed within the space defined by the annulus 26 is a cylindrically-shaped, rotatable, cylinder-like member 28 adaptable to rotate about the inner cylinder 18 and within the outer cylinder 12. The rotatable member 28, as best seen in FIG. 2, is formed having a central body portion 30 and extending inwardly therefrom are a plurality of inner, finer-like members 32 extending longitudinally continuously or segmented throughout the length of the inner surface of the central body 30. Similarly, a plurality of outer, finger-like members 34 extend outwardly from the central body 30 continuously or in segments throughout the length of the outer surface thereof. The plurality of inner, finger members 32 are spaced apart a preselected distance and the space between two inner finger members 32 defines an inner longitudinal, continuous or segmented, groove 36 that extends throughout the length of rotatable member 28. In like fashion, the plurality of outer finger members 34 are spaced apart a preselected distance and the space between two outer finger members 34 defines an outer longitudinal groove 38 that extends throughout the length of rotatable member 28.

Although shown as being substantially parallel to the longitudinal axis of the heat exchanger 10, it will be understood that the inner fingers 32 and the outer fingers 34 may both be formed to effect a spiral or helical configuration in or about the central body portion 30 with the result that the inner grooves 36 and the outer grooves 38 extend spirally throughout the length of the rotatable member 28. The angle of spiral as measured from the longitudinal axis of the device 10 conceivably may be of any angle, ranging from a small acute value to that of one approaching the value of ninety degrees.

The rotatable member 28 has formed or secured at one end (FIG. 1) a plurality of vanes 40 having a somewhat arcuate shape and being disposed adjacent inlet port 14 of the device 10. In addition, the member 28 has formed or secured at its other end a plurality of vanes 42 having a somewhat arcuate shape and being disposed adjacent outlet port 16 of the device 10. The vanes 40 are adaptable to receive heat transfer medium that is forcibly moved thereagainst. The pressurized heat transfer medium, as shown by the arrow 44, is effective to cause vanes 40 to move within annulus 26 and thereby rotate the member 28. The heat transfer medium as it imparts angular motion to the member 28 is directed by its pressurized condition to move from vanes 40 into the annulus 26 and also into inner grooves 36 and outer grooves 38 on the member 28. The pressured medium continues to move through the annulus 26, the inner grooves 36 and the outer grooves 38 until it moves against vanes 42 disposed adjacent the outlet end 16 of the device 10. The vanes 42 are effective to direct the pressured medium through the outlet 16, as shown by arrow 46, and thereby completes a cycle of circulation of heat transfer medium through the device 10.

Counter flow circulation of another heat transfer medium through the device 10 is shown by arrow 48 at the entry end 20. The counter flow medium is forced by pressure through an inner cylindrical chamber 48 of the internal cylinder 18 to the exit end 22 and moves therefrom as depicted by arrow 50 to thereby complete a cycle of counter flow circulation of heat transfer medium through the device 10.

Conventional heat transfer applications rely upon a fixed rate of fluid flow or movement of other heat transfer medium. In order to construct a so-called super-compact heat exchanger, as envisioned herein, the goal is to increase the heat transfer coefficients of the heat transfer surfaces to an extremely high degree, in the order of a factor of 10. A conventional heat transfer device with the flow in a laminar regime having a fixed flow rate would of necessity have to increase its flow rate a thousand times with an unmanageable increase in pressure drop in order to obtain an increase of heat transfer coefficients in the order of 10.

The present invention achieves an increase of heat transfer coefficients by a factor of ten, but at the same time maintains the rate of flow or medium movement on a constant basis. Rotational motion may range from rather low speeds up to 10,000 RPM or beyond in association with the longitudinally grooved configuration of rotatable member 28 induces extremely active circulation between an outer circumferential surface 52 of the internal cylinder 18 and distal ends 54 of the inner fingers 32. Similarly, there occurs extraordinarily turbulent or tornadic circulation between an inner circumferential surface 56 of the outer cylinder 12 and distal ends 58 of the outer finger members 34 that assist in increasing heat transfer coefficients. In addition, any preselected rotational speed induces Taylor vorticity activity within the inner grooves 36 and the outer grooves 38 that serves to increase the heat transfer coefficients. The combined result of the aforesaid pattern of circulation and Taylor vorticity achieves an increase of heat transfer coefficients by a factor of at least 10. At the same time an increase in pressure drop occurs, but by a factor of only 60 rather than a factor of 1000 that would necessarily be required to achieve a tenfold increase of heat transfer coefficients by a conventional heat exchanger.

Figure 5:
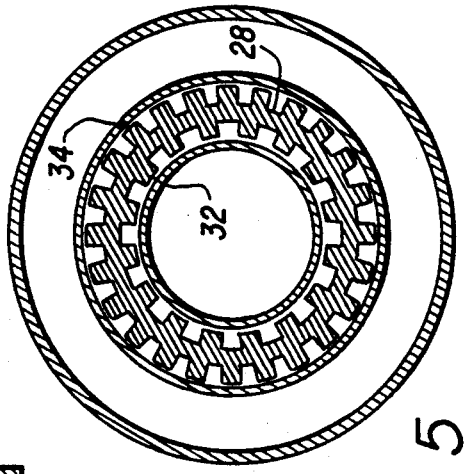
FIG. 5 is a sectional view taken along the lines 5—5 of FIG. 4 showing the modified construction of an additional outer cylinder.
Figure 4:
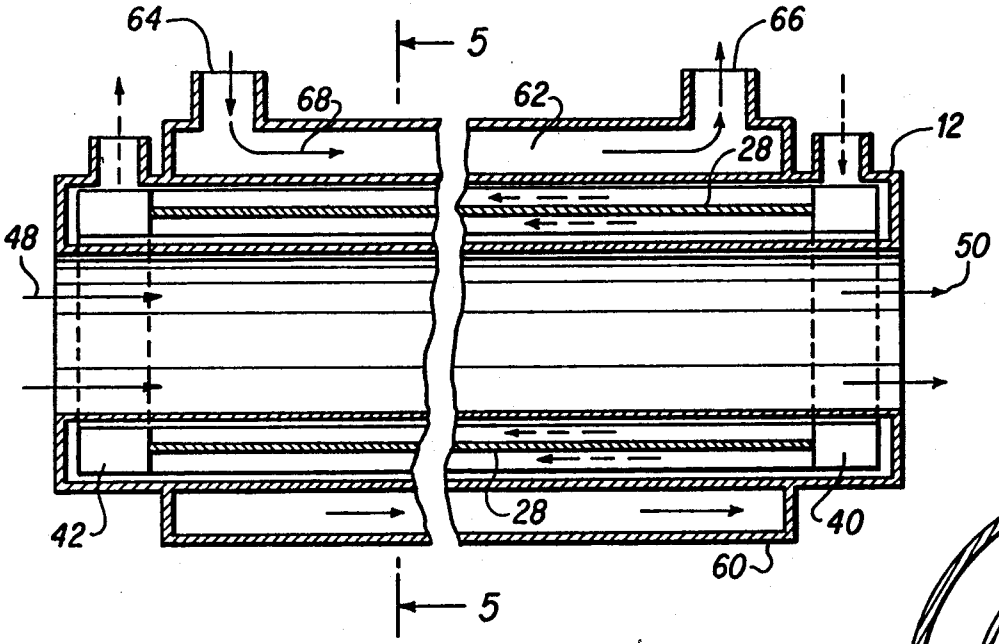
FIG. 4 is a longitudinal sectional view similar to FIG. 1 showing a modified construction of the device that provides for additional paths of fluid flow therethrough.

Now referring to FIG. 4, there is shown an additional outer cylinder 60 enclosing the outer cylinder 12 defining therewith an annulus or chamber 62 through which pressurized heat exchange medium is caused to flow. The outer cylinder 60 has formed at one end an inlet port 64 and at its other end an outlet port 66 for the entry and exit of heat exchange medium as depicted by the arrows 68. FIG. 5 shows the rotatable member 28 disposed within the annulus 26 in a manner similar to the configuration of FIG. 2. However, it should be noted and understood that the space between the distal ends of the inner 32 finger members and their containing circumferential surface is less than a similar space between finger members 34 and their containing circumferential surface of the outer 14 cylinder member surface of the inner 18 cylinder member. The closer proximity between the ends of the finger members and the adjacent circumferential surfaces of the inner and outer cylinders permits a further increase in circulational flow with a resultant increase in heat transfer coefficients.

Figure 6:
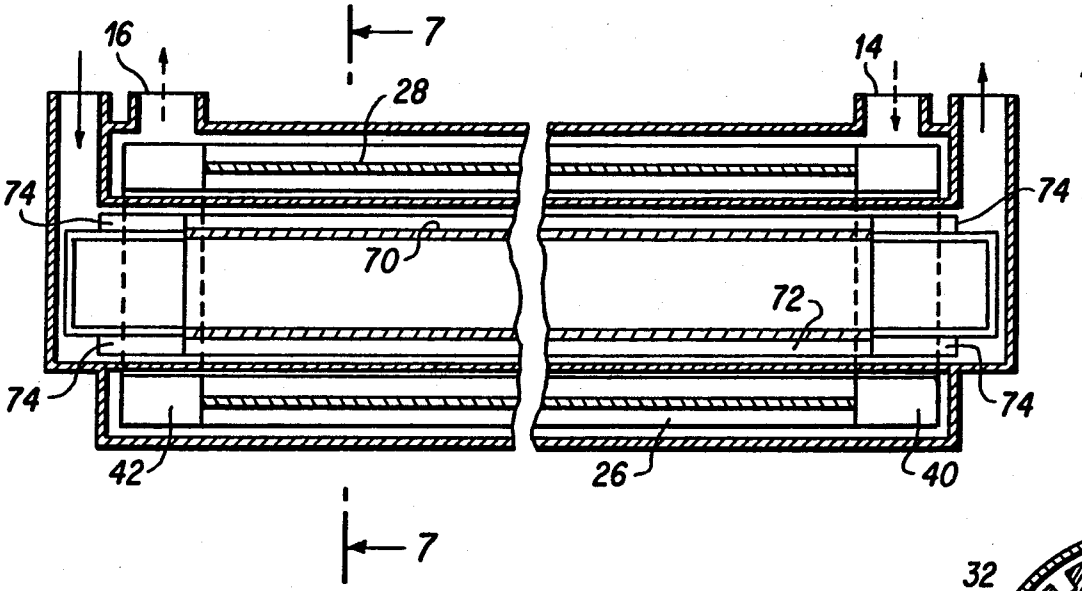
FIG. 6 is a longitudinal sectional view similar to FIGS. 1 and 3 showing an additional embodiment of the invention wherein a plurality of grooved, rotatable members are provided for receiving the moving fluid as it flows through the device.
Figure 7:
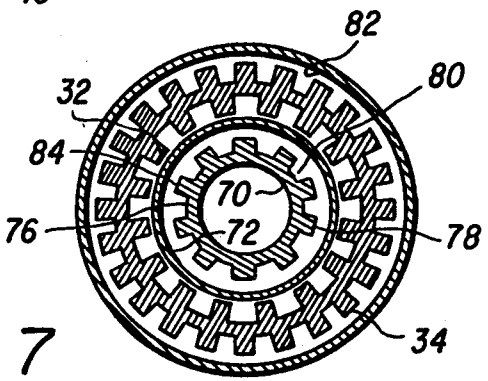
FIG. 7 is an end, sectional view taken along the lines 6—6 of FIG. 5 showing details of construction of the plurality of grooved, rotatable members respectively disposed between the outer and internal cylinders and within the internal cylinder of the device.

Directing attention to FIG. 6, there is shown a device 10 similar to that depicted in FIG. 1 except that an additional rotatable member 70 is disposed within a chamber 72 of the inner cylinder 18. The rotatable member 70 has formed or secured thereon a plurality of vanes 74 disposed adjacent an inlet port and an outlet port of the internal cylinder 18 that permit pressurized heat exchange medium to enter into and exit from the chamber 72. It can be seen that the rotatable member 70 may revolve in the same direction or in a direction opposite from the angular direction of the rotatable member 28. The rotatable member 70 is formed having a central body portion 76 and extending outwardly therefrom are a plurality of finger-like members 78 throughout the length of the member 70. The finger members 78 are spaced apart a preselected distance and each space between finger members defines a longitudinal, continuous or segmented groove 80 that extends throughout the length of the rotatable member 70. Rotation of the member 70 is effective to cause extraordinary turbulent and tornadic circulation between an inner circumferential surface 82 of inner cylinder 18 and distal ends 84 of the fingers 78 along with Taylor vorticity activity within the grooves 80 between the finger members 78. The combined result is to achieve a further increase in heat transfer coefficients.

Figure 8:
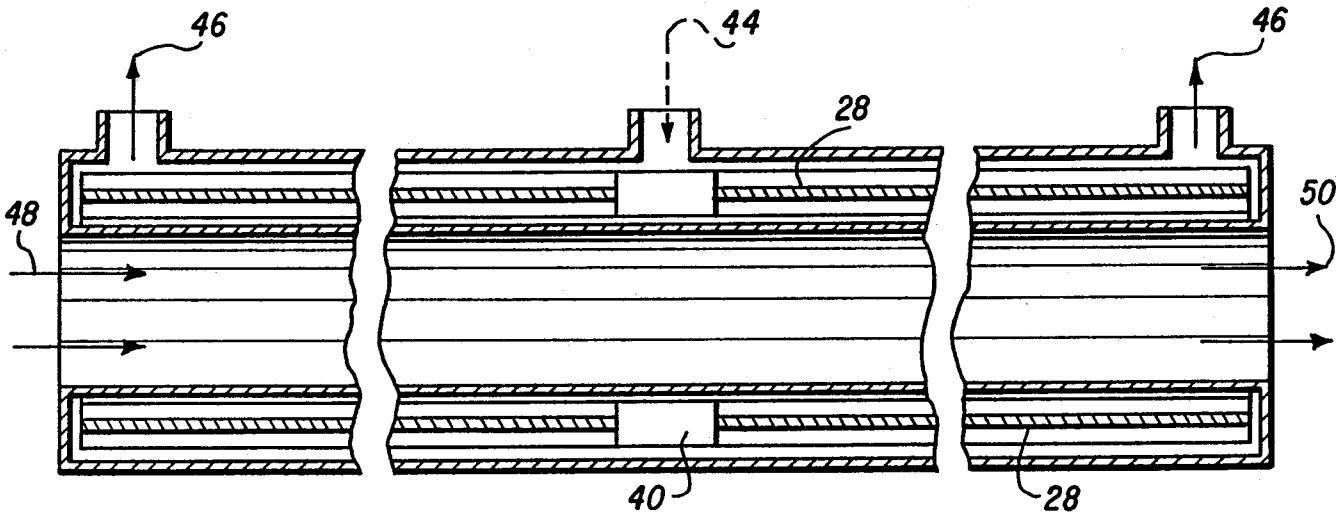
FIG. 8 is a longitudinal sectional view similar to FIG. 1 showing the turbine portion of the rotatable member disposed substantially intermediate its ends so as to equalize pressure thereon and avoid the need for thrust bearing structure.
Figure 9:
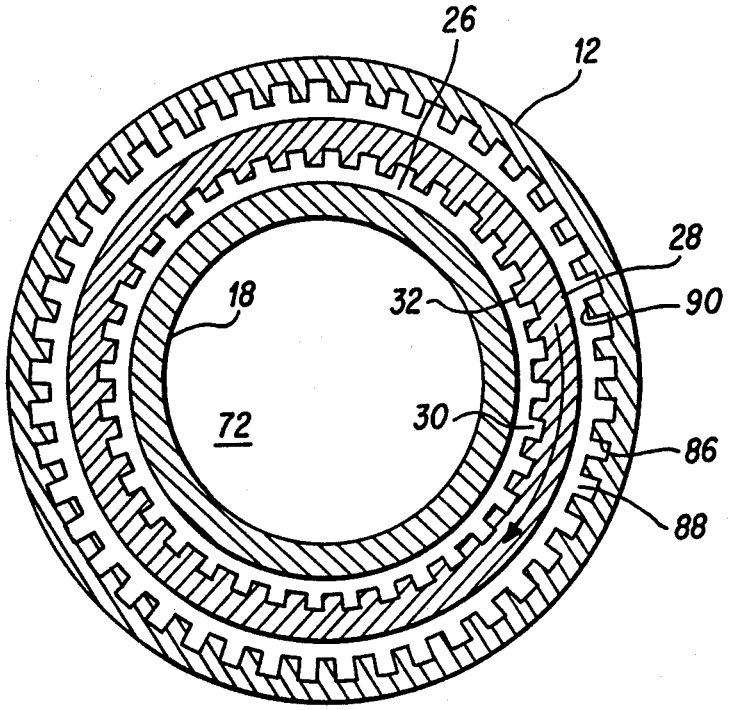
FIG. 9 shows a variation of FIG. 2 to show that the outer stationary cylinder has internal grooves, the external surface of the rotating cylinder has a smooth surface, and the external surface of the inner stationary cylinder has a smooth surface.

FIG. 8 shows an alternate arrangement for location of the vanes secured to the rotatable member 28. By locating the vanes centrally along the length of the member 28, it is possible to avoid the need for thrust bearing structure at outer ends of the member and thereby avoid added expense of construction of the device. The theory of operation and the results achieved in increasing heat transfer coefficients remain the same.

In the operation of the invention as shown in FIG. 1 and as applicable to all other embodiments, heat transfer medium is forced to flow at a rapid velocity from the entry end 20 of the device 10 through the chamber 72 of the inner cylinder 18 and thereafter flows out through exit end 22. Similarly, another pressurized heat transfer medium is forced to flow at a rapid speed from the inlet port 14 of the device 10 into contact with the inlet vanes 40 and then into contact with the inner grooves 36, the outer grooves 38, the distal ends of the inner fingers 32, the distal ends of the outer fingers 34, the inner circumferential surface of the outer cylinder 12, and the outer circumferential surface of the inner cylinder 18 through the annulus 26. The pressurized heat transfer medium rotates the member 28 at very high speeds ranging in the order of up to at least 10,000 RPM and is caused to circulate in a violent, turbulent, tornadic manner. In addition, there is induced within the grooves Taylor vorticity activity that combines with the high rate of circulation flow rate to achieve an increase of heat transfer coefficients between the chamber 72 and the annulus 26 by a factor of at least ten. The pressurized fluid continues to flow through the annulus 26 and contacts the vanes 42 adjacent the outlet port 16 and exits therethrough. As illustrated, the flow of heat exchange medium through the chamber 72 is in a direction opposite to or counter to the flow of heat exchange medium through the annulus 26 so as to achieve a maximum rate of heat transfer coefficients.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

I claim:

1. An improved heat exchange device comprising outer stationary cylindrical means having inlet and outlet means, inner stationary cylindrical means having an inlet end portion and an outlet end portion;

said outer and said inner stationary cylindrical means defining a longitudinal annulus therebetween;

rotatable, cylindrical means floatably disposed within said annulus between said outer and said inner stationary cylindrical means and being free to rotate therein;

said rotatably cylindrical means having formed thereon a plurality of projections that define a plurality of grooves;

viscous fluid means adaptable for movement through said longitudinal annulus over and about said rotatable, cylindrical means;

said rotatable cylindrical means when moving angularly within said annulus between said outer and said inner stationary cylindrical means being effective to cause vortical motion circulation to said fluid means within said annulus between an inner circumferential surface of said outer stationary cylindrical means and an outer circumferential surface of said inner stationary cylindrical means so as to greatly increase the heat transfer coefficient therebetween.

2. An improved heat exchange device as claimed in claim 1 including turbine means formed on said rotatable cylindrical means for receiving pressurized heat exchange medium to impart angular motion thereto.

3. An improved heat exchange device as claimed in claim 2 including external power means to augment the angular motion of said rotatable cylindrical means.

4. An improved heat exchange device comprising outer stationary cylindrical means having an inlet end portion and an outlet end portion, inner stationary cylindrical means having inlet means and outlet means, said outer and said inner stationary cylindrical means defining a longitudinal annulus therebetween;

rotatable cylindrical means floatably disposed within said annulus between said outer and said inner stationary cylindrical means and being free to rotate therein, said rotatable cylindrical means having an inner and an outer circumferential surface formed thereon, fluid means adaptable for movement through said longitudinal annulus over and about said rotatable cylindrical means;

said rotatable cylindrical means when moving angularly within said annulus between said outer and said inner stationary cylindrical means being effective to cause vortical motion circulation to said fluid means within a first portion of said annulus defined by an inner circumferential surface of said outer stationary cylindrical means and said outer circumferential surface of said rotatable cylindrical means and within a second portion of said annulus defined by an outer circumferential surface of said inner stationary cylindrical means and said inner circumferential surface of said rotatable cylindrical means, whereby a heat transfer coefficient between said outer stationary cylindrical means and said inner stationary cylindrical means is greatly increased.

5. An improved heat exchange device as claimed in claim 4 wherein a plurality of outer projections are formed on said outer circumferential surface of said rotatable cylindrical means.

6. An improved heat exchange device as claimed in claim 5 wherein a plurality of inner projections are formed on said inner circumferential surface of said rotatable cylindrical means.

7. An improved heat exchange device as claimed in claim 6 wherein said outer and said inner projections formed on said outer and inner circumferential surfaces of said rotatable cylindrical means define a plurality of outer and inner grooves.

8. An improved heat exchange device as claimed in claim 7 wherein said plurality of outer and inner grooves are formed longitudinally along said outer and said inner circumferential surfaces of said rotatable cylindrical means.

9. An improved heat exchange device as claimed in claim 8 wherein said outer and said inner grooves formed longitudinally of said outer and said inner circumferential surfaces of said rotatable cylindrical means are segmented.

10. An improved heat exchange device comprising outer stationary cylindrical means having an inlet end portion, an outlet end portion and an inner circumferential surface, inner stationary cylindrical means having inlet means, outlet means, and an outer circumferential surface, said inner circumferential surface of said outer stationary cylindrical means and said outer circumferential surface of said inner stationary cylindrical means defining a longitudinal annulus therebetween;

rotatable cylindrical means floatably disposed within said annulus between said inner and said outer circumferential surfaces of said outer and said inner stationary cylindrical means, said rotatable cylindrical means having an inner and an outer circumferential surface formed thereon, said rotatable cylindrical means when moving angularly within said annulus between said inner and said outer circumferential surfaces of said outer and said inner stationary cylindrical means being effective to cause vortical motion circulation within a first portion of said annulus defined by said inner circumferential surface of said outer stationary cylindrical means and said outer circumferential surface of said rotatable cylindrical means and within a second portion of said annulus defined by said outer circumferential surface of said inner stationary cylindrical means and said inner circumferential surface of said rotatable cylindrical means, whereby a heat transfer coefficient between said outer stationary cylindrical means and said inner stationary cylindrical means is greatly increased.

11. An improved heat exchange device as claimed in claim 10 wherein a plurality of inner projections are formed on said inner circumferential surface of said outer stationary cylindrical means.

12. An improved heat exchange device as claimed in claim 11 wherein a plurality of inner projections are formed on said inner circumferential surface of said rotatable cylindrical means.

13. An improved heat exchange device as claimed in claim 12 wherein said inner projections formed on said inner circumferential surface of said outer stationary cylindrical means define a plurality of stationary grooves, and said inner projections formed on said inner circumferential surface of said rotatable cylindrical means define a plurality of rotatable grooves.

14. An improved heat exchange device as claimed in claim 13 wherein said stationary grooves and said rotatable grooves are segmented.

15. An improved heat exchange device as claimed in claim 10 wherein a plurality of inner projections are formed on said inner circumferential surface of said outer stationary cylindrical means.

16. An improved heat exchange device as claimed in claim 15 wherein a plurality of outer projections are formed on said outer circumferential surface of said inner stationary cylindrical means.

17. An improved heat exchange device as claimed in claim 16 wherein a plurality of inner projections are formed on said inner circumferential surface of said rotatable cylindrical means.

18. An improved heat exchange device as claimed in claim 17 wherein a plurality of outer projections are formed on said outer circumferential surface of said rotatable cylindrical means.

* * * * *